US009789451B2

(12) United States Patent
Ripoll et al.

(10) Patent No.: US 9,789,451 B2
(45) Date of Patent: Oct. 17, 2017

(54) METHOD AND ELECTRO-FLUIDIC DEVICE TO PRODUCE EMULSIONS AND PARTICLE SUSPENSIONS

(75) Inventors: Antonio Barrero Ripoll, Sevilla (ES); Ignacio González-Loscertales, Málaga (ES); Venkata Ramana Gundabala, Atlanta, GA (US); Alberto Fernandes-Nieves, Atlanta, GA (US); Regina Gil Garcia, legal representative, Sevilla (ES)

(73) Assignees: Georgia Tech Research Corporation, Atlanta, GA (US); Universidad de Sevilla, Sevilla (ES); Universidad de Málaga, Málaga (ES)

( * ) Notice: Subject to any disclaimer, the term of this patent is extended or adjusted under 35 U.S.C. 154(b) by 620 days.

(21) Appl. No.: 13/392,908

(22) PCT Filed: Aug. 30, 2010
(Under 37 CFR 1.47)

(86) PCT No.: PCT/EP2010/005307
§ 371 (c)(1),
(2), (4) Date: Apr. 26, 2013

(87) PCT Pub. No.: WO2011/023405
PCT Pub. Date: Mar. 3, 2011

(65) Prior Publication Data

US 2013/0277461 A1 Oct. 24, 2013

Related U.S. Application Data

(60) Provisional application No. 61/237,764, filed on Aug. 28, 2009.

(51) Int. Cl.

| | |
|---|---|
| ***B01F 3/08*** | (2006.01) |
| ***B01F 13/00*** | (2006.01) |
| *B01F 5/00* | (2006.01) |

(52) U.S. Cl.
CPC ..... *B01F 3/0815* (2013.01); *B01F 3/0807* (2013.01); *B01F 13/0062* (2013.01);
(Continued)

(58) Field of Classification Search
CPC ... B01J 13/0811; B01F 3/0815; B01F 3/0807; B01F 13/0062; B01F 2215/0445; B01F 2005/0034; B01F 13/0076
(Continued)

(56) References Cited

U.S. PATENT DOCUMENTS 5,762,775 A * 6/1998 DePaoli et al. ..... 204/554
7,914,714 B2 * 3/2011 Anchordoquy ..... B01J 13/04 264/4.1

(Continued)

FOREIGN PATENT DOCUMENTS

WO 2006096571 A2 9/2006
WO 2006120264 A2 11/2006

(Continued)

OTHER PUBLICATIONS

International Search Report for related Application No. PCT/EP2010/005307; dated Mar. 12, 2010.

*Primary Examiner* — Daniel S Metzmaier
(74) *Attorney, Agent, or Firm* — Troutman Sanders LLP; Ryan A. Schneider

(57) ABSTRACT

The invention refers to a method, and to a device to produce emulsions and particle suspensions by using electro-hydrodinamic forces and microfluidics This combined use allow the production of droplets with mean diameters which may be either smaller than those obtained in conventional microfluidic devices or larger than those obtained by electrospray, bridging the gap between the two methods acting independently.

15 Claims, 5 Drawing Sheets

(52) U.S. Cl.
CPC .. *B01F 13/0076* (2013.01); *B01F 2005/0034* (2013.01); *B01F 2215/0445* (2013.01)

(58) Field of Classification Search
USPC ..... 239/690; 516/20, 53, 77, 924
See application file for complete search history.

(56) References Cited

U.S. PATENT DOCUMENTS

| | | | | |
|---|---|---|---|---|
| 2006/0057259 | A1* | 3/2006 | Ripoll | B01J 13/04 426/235 |
| 2009/0131543 | A1* | 5/2009 | Weitz | A61K 9/113 516/54 |
| 2011/0116993 | A1* | 5/2011 | Nam | B01J 13/14 422/507 |
| 2011/0229545 | A1* | 9/2011 | Shum | B01F 3/0807 424/409 |
| 2016/0375413 | A1* | 12/2016 | Weitz | B01F 3/0807 428/402.21 |

FOREIGN PATENT DOCUMENTS

| | | | |
|---|---|---|---|
| WO | WO 2008/121342 | A2 * | 10/2008 |
| WO | WO 2009/039458 | A2 * | 3/2009 |

* cited by examiner

METHOD AND ELECTRO-FLUIDIC DEVICE TO PRODUCE EMULSIONS AND PARTICLE SUSPENSIONS

CROSS-REFERENCE TO RELATED APPLICATIONS

This application is a US National Stage of International Application No. PCT/EP2010/005307, filed 30 Aug. 2010, which claims the benefit of U.S. Provisional Application No. 61/237,764, filed 28 Aug. 2009, both herein fully incorporated by reference.

The invention refers to a method and device to produce emulsions and particle suspensions by using electro-hydrodinamic forces and microfluidics. This combined use allow the production of droplets with mean diameters which may be either smaller than those obtained in conventional microfluidic devices or larger than those obtained by electrospray, bridging the gap between the two methods acting independently.

BACKGROUND ART

Top-down methods to produce micro and nanoparticles require the division of a macroscopic (i.e. millimetric) piece of matter, generally a liquid, into tiny offsprings of micro or nanometric size. Surface tension strongly opposes the huge increase of area inherent to this dividing process. Thus, to produce such small particles, energy must be properly supplied to the interface. This energy is the result of a mechanical work done on the interface by any external force field, i.e., hydrodynamic forces, electrical forces, etc. Two kinds of approaches can be distinguished, depending on how the energy is supplied.

In one approach, such as in the mechanical emulsification techniques, the force fields (extensional and shear flows) employed to break up the interface between two immiscible liquids are so inhomogeneous that, in general, the offspring droplets present a very broad size distribution. Nevertheless, a high degree of monodispersity might be achieved for a particular combination of the emulsification parameters (shear rate, rotation speeds, temperature, etc.) and a given combination of substances. However, such a desirable condition might not exist if one of the substances is changed, if a new one is added, or if a different size is desired. The same occurs if capsules must be formed. Furthermore, in many instances, the formation of the structure depends on chemical interactions, usually preventing the process from being applicable to a broad combination of substances.

In the other approach, which has the advantage of being based on purely physical mechanisms, the forces steadily and smoothly stretch the fluid interface without breaking it until at least one of its radii of curvature reaches a well-defined micro or nanoscopic dimension d; at this point, the spontaneous breakup of the stretched interface by capillary instabilities yields monodisperse particles with a size of the order of d. These types of flows are known as capillary flows due to the paramount role of the surface tension. For example, the formation and control of single and coaxial jets with diameters in the micrometer/nanometer range, and its eventual varicose breakup, lead to particles without structure (single jets) or compound droplets (coaxial jets), with the outer liquid encapsulating the inner one. On the other hand, if the liquid solidifies before the jet breaks, one obtains fibers (single jet), or coaxial/hollow nanofibers (coaxial jets). The mean size of the particles obtained with these methods ranges from hundreds of micrometers to several nanometers, although the nanometric range is generally reached when electric fields are employed. The particles obtained using this approach are, in general, nearly monodisperse and its employment enables, in the case of capsules, a precise tailoring of both the capsule size and the shell thickness. All these features make this approach particularly attractive for many technological applications.

Capillary flows capable of stretching out one or more interfaces up to the micro or submicron dimension have been the subject of considerable research, both experimental and theoretical, in the past few years. Although the Reynolds numbers of these capillary flows is of the order unity and smaller, the numerical simulation of some of them is complex due to (a) the disparity of length scales, which can vary more than three orders of magnitude, (b) the existence of a free surface that must be consistently determined from the solution of the problem, and (c) the fact that the region where the interface breaks is time dependent in spite of the steady character of the flow upstream of the breaking zone.

1.—Different Methods for Stretching Out Fluid Interfaces

In general, there are two ways to stretch fluid interfaces down to micrometric or sub-micrometric dimensions (A. Barrero and I. G. Loscertales, *Micro and nanoparticles via capillary flows*, Annual Rev. Fluid Mechanics, 39, 89-106, 2007). The first forces a liquid through an opening in a solid wall with characteristic dimension d and brings the curvature of the interface to that size; for example, forcing a fluid through a pipe or through a membrane with characteristic diameter or pore size d. For practical purposes, however, such small apertures are prone to clog for sizes below a few microns. The second approach uses suitable force fields instead of walls, to bring the curvature of the interface down to a scale d, much smaller than any boundary dimension. These forces are, generally, surface tension and fluid dynamic forces (pressure, inertia, and viscosity), although electrical and magnetic forces can also be used when the fluid reacts under these fields.

(A) Flows Through Micron-Size Apertures

A simple example of these flows is the injection of a fluid of density $\rho$ and viscosity $\mu$ through a needle of micrometric diameter d immersed in an immiscible host fluid of density $\rho_o$ and viscosity $\mu_o$. The host fluid, which can also be a vacuum, may either be at rest or in motion with respect to the needle. At the end of the needle the interface between the two media evolves, governed by the following dimensionless parameters: the Weber and the Capillary numbers based on the characteristic velocity v of the injected fluid and on the interfacial tension $\gamma$ between the two fluids, $We=\rho v^2 d/\gamma$ and $Ca=\mu v/\gamma$ respectively, the Reynolds numbers of the host fluid flow based on its characteristic velocity $v_o$, $Re_o=\rho_o v_o d/\mu$, the viscosity and density ratios between the host and the injected fluids, $\bar{\mu}$ and $\bar{\rho}$, and finally, the angle $\alpha$ between the direction of $v_o$ and the needle axis. For a pair of fluids and a given geometrical configuration (given values of $\bar{\mu}$, $\bar{\rho}$ and $\alpha$), the flow is governed by We, Ca, and $Re_o$, which may vary in a broad range of values, thus giving rise to a very rich diversity of flows generally classified as dripping and jetting modes, which are respectively shown in FIGS. 1A and 1B.

The formation of jets and drops (or bubbles) at the end of a tube, and the transition from jetting to dripping, has been the subject of numerous investigations (O. A. Basaran, *Small-scale free surface flows with breakup: Drop formation and emerging applications*, AIChE J. 48, 1842-48, 2002; C. Clanet C & J. C. Lasheras. *Transition from dripping to jetting*. J. Fluid Mech. 383, 307-326, 1999). Droplets generated in the dripping mode are generally more monodisperse than those generated in the jetting mode. In particular, Umbanhowar et al. (2000) reported a method to produce nearly monodisperse emulsions (standard deviation less than 3%) that consists of detaching droplets from a capillary tip ($\alpha$=0) in the presence of a coflowing stream (P. B. Umbanhowar, V. Prasad, D. A. Weitz, *Monodisperse emulsion generation via drop break off in a coflowing stream*. Langmuir 16, 347-351, 2000). The host fluid drags the meniscus formed at the end of the tip and detaches it to generate a drop with a diameter of the order of d. The coflowing method has been also exploited to generate highly monodisperse micron-size droplets of nematic liquid crystals to form two-dimensional (2D) and three-dimensional (3D) arrays for electro-optical applications (D. Rudhardt, A. Fernandez-Nieves, D. R. Link, D. A. Weitz, *Phase-switching of ordered arrays of liquid crystal emulsions*, Appl. Phys. Lett. 82, 2610, 2003; A. Fernández-Nieves, D. R. Link, D. Rudhardt, D. A. Weitz, *Electro-optics of bipolar nematic liquid crystal droplets*. Phys. Rev. Lett. 92, 05503, 2004; A. Fernandez-Nieves, D. R. Link, D. A. Weitz, *Polarization dependent Bragg diffraction and electro-optic switching of three-dimensional assemblies of nematic liquid crystal droplets*, Appl. Phys. Lett. 88, 121911, 2006).

The fact that the droplet pinch-off occurs at distances of the order of d (i.e., dripping) from where the needle ends severely narrows the break-up wavelength range. The needle diameter d acts as a wave filter, efficiently killing those wavelengths slightly away from a dominant one, which is of the order of d. This filtering effect is responsible for the extremely narrow size spectrum of the detached droplets. For the jetting mode, however, the pinch off occurs at a distance much larger than d from the needle, allowing the break-up wavelength range to broaden. Nonetheless, relatively monodisperse droplets are still obtained from these jets because the perturbation growth rate versus the perturbation wavelength usually exhibits a sharp maximum.

Other extensional flows within micron-sized channels have been also used to break single droplets in two daughter droplets whose size may be precisely controlled (D. R. Link, S. L. Anna, D. A. Weitz, H. A. Stone, *Geometrically mediated breakup of drops in microfluidic devices*. Phys. Rev. Lett. 92, 054503, 2004). In this implementation, an emulsion of micron-sized droplets continuously flows across a T-junction; the pressure-driven extensional flow splits the droplets in two, and each daughter droplet flows along each branch of the T.

(B) Micro-Flows Driven by Hydrodynamic Focusing

In micro-flows driven by hydrodynamic focusing, the interface between two fluids is stretched out by a highly accelerated converging motion of one of them that sucks the other one toward the converging point. One of the earliest implementations of this type of flow is the so-called selective withdrawal procedure. The first studies of this date back to the end of the 1940s (A. Craya, *Recherches theoretiques sur l'ecoulement de couches superposees de fluids de densités différentes*. L'Huille Blanche 4, 44-55, 1949; W. R. Debler, *Stratified flow into a line sink*, J. Eng. Mech. Div., Proc. Am. Soc. Civil Eng. 85, 51-65, 1959). The technique was largely employed in the field of geophysical flows before Cohen et al. (2001) applied the technique to coat micro-particles (I. Cohen I, H. Li, J. L. Hougland, M. Mrksich, S. R. Nagel. *Using selective withdrawal to coat microparticles*. Science 292, 265-267, 2001). In its simpler version, shown in FIG. 2, the tip of a tube of diameter D is located at a height H above an interface separating two immiscible liquids. By applying a steady suction throughout the tube, the resulting converging flow of the lighter fluid (the focusing liquid in this case) sets the other liquid into motion. For sufficiently small values of the suction, only the lighter liquid is withdrawn throughout the tube: the hydrodynamic forces cannot overcome the capillary forces, and the deformed interface eventually comes to rest. An increase in the suction leads to a transition where the heavier liquid is also withdrawn in the form of a steady-state thin jet of diameter d co-flowing with the focusing liquid (the lighter one) d being much smaller than D. The capillary breakup of this jet gives rise to a stream of droplets with a mean diameter of the order of that of the jet. For a given pair of liquids and a given tube diameter, there are two controlling parameters: the pressure drop along the tube, $\Delta p$, which controls the flow rate Q through the tube, and the distance between the tube exit and the interface, H. For a given value of H, increasing $\Delta p$ results in a thicker jet, whereas for a given $\Delta p$, increasing H results in a thinner jet. In terms of dimensionless parameters, the dimensionless jet diameter d/D depends on the Reynolds number $Re_o=\rho_o Q/(\mu_o D)$ and H/D. Note that for a given H/D, no steady-state jet is formed unless the Reynolds number becomes larger than a critical value implying there is a critical flow rate inherent to this technique.

Another implementation of this type of flow is the so-called flow focusing procedure (A. Gañán-Calvo, *Generation of steady liquid micro-threads and micron-sized sprays in gas streams*, Phys. Rev. Lett. 80, 285, 1998; A. Barrero, *A novel pneumatic technique to generate steady capillary microjets, J. Aerosol Sci.* 30, 117-125, 1999), where a pressure drop $\Delta p$ across a thin plate orifice of diameter D causes a converging motion of the focusing fluid. A second fluid is injected at a rate q through a tube of diameter $D_t$, whose end is located a distance H in front of the orifice, $D_t$~H~D. For a given value of H, and an appropriate range of values of both q and $\Delta p$, the interface at the end of the tube develops a cusp-like shape from whose vertex a very thin steady-state jet of diameter d is issued (see FIG. 3).

The jet and the focusing fluid coflow throughout the orifice. The jet eventually breaks up into a stream of droplets with a mean diameter of the order of d. In the relevant cases, the characteristic jet diameter is much smaller than the orifice diameter d<<D. We note that flow focusing can also be achieved in two-dimensions (J. B. Knight, A. Vishwanath, J. P. Brody, R. H. Austin, *Hydrodynamic focusing on a silicon chip: mixing nanoliters in microseconds*, Phys. Rev. Lett. 80, 3863-3866, 1998.).

Note that, as in the selective withdrawal procedure, for a given pair of liquids and a given value of H, there are two controlling parameters: the pressure drop across the orifice, $\Delta p$, which controls the flow rate Q of the focusing fluid, and the injected flow rate q of the focused fluid. For a given value of q, the increase of $\Delta p$ results in a thinner jet, whereas for a given $\Delta p$, the increase of q results in a thicker one. The dimensionless diameter of the jet, d/D, is a function of the Weber numbers of the focused and focusing flows, $\rho q^2/(D^3\gamma)$ and $D\,\Delta p/\gamma$, respectively, the ratio between the Capillary to the Reynolds number of the two flows, $\mu=\mu^2/(\rho D\gamma)$ and $\mu_0=\mu_o^2/(\rho D\gamma)$, the density ratio $\bar{\rho}$ of the two fluids and the geometrical dimensionless parameters, $D_t/D$ and H/D. Clearly, for a given pair of fluids and a given geometry, the jet diameter only depends on the Weber numbers of the two flows. Furthermore, in many experimental cases where a liquid is extruded by a focusing fluid, the viscosities of both fluids play almost no role, and the phenomenon can be predicted by the simple Bernouilli law, $d=8\rho q^2/(\pi^2\Delta p)$.

As with selective withdrawal, for a given $\Delta p$ there is a minimum flow rate $q_{min}$, below which no steady jet can be formed. For this $q_{min}$, the jet diameter reaches its minimum value $d_{min}$, which is approximately given by the condition in which the pressure drop $\Delta p$ balances the surface tension $\gamma/d_{min}$; this yields $d_{min}=\gamma/\Delta p$. For the case in which the focusing fluid is a gas of density $\rho_g$, the maximum value of $\Delta p$ is of the order of $\rho_g a^2$, where a is the characteristic sound velocity of the gas; thus, for typical values of the surface tension $\gamma$, one obtains $d_{min}$~1 micron.

Note that for the flows considered in this section, the diameters of the tubes and of the orifice are usually much larger than the jet diameter of the focused fluid; therefore, the solid walls do not filter out any break-up wavelengths, and consequently the droplets formed present a broader size distribution than those obtained by the co-flowing method in the dripping regime, considered in Section A (Flows through micron-size apertures). Furthermore, there is a slight difference between the two implementations described in this section that might influence the size distributions of the resulting droplets based on the stability of the flow, because in the flow focusing procedure the discharge of the focusing flow into a quiescent fluid, just after crossing the orifice, forms a shear layer that is unstable and develops into turbulence. This might affect the breakup of the thin jet when it occurs at distances larger than D downstream from the orifice.

There have been successful experiments relevant in producing emulsions (S. L. Anna, N. Bontoux, N. A. Stone. *Formation of dispersions using "flow focusing" in microchannels*. Appl. Phys. Lett. 82, 364-367, 2003) and microfoams (J. M. Gordillo, Z. Cheng Z, A. M. Gañán-Calvo, M. Márquez, D. A. Weitz D A. *A new device for the generation of microbubbles*. Phys. Fluids 16, 2828-2834, 2004) using a flow-focusing geometry integrated into a planar microchannel device. Results by Anna et al. (2003) show that the drop size as a function of flow rates and flow rate ratios of the two liquids (the focusing and the focused ones) includes a regime where the drop size is comparable to the orifice width (dripping) and one (jetting) where drop size is dictated by the diameter of a thin focused thread so that drops much smaller than the orifice are formed.

(C) Micro and Nanoflows Driven by Electrical Forces (i) Electrospray.

The interaction of an intense electrical field with the interface between a conducting liquid and a dielectric medium has been known to exist since William Gilbert (1600), who reported the formation of a conical meniscus when an electrified piece of amber was brought close enough to a water drop (W. Gilbert, *De Magnete,* 1600. Transl. P. F. Mottelay. Dover, UK. 1958). Interface deformation is caused by the force that the electrical field exerts on the net surface charge induced by the field itself. Experiments show that the interface reaches a motionless shape if the field strength is below a critical value, whereas for stronger fields the interface becomes conical, issuing mass and charge from the cone tip in the form of a thin jet of diameter d. In the latter case, the jet becomes steady if the mass and charge it emits are supplied to the meniscus at the same rate. Taylor (1964) explained the conical shape of the meniscus as a balance between electrostatic and surface tension stresses; since then the conical meniscus has been referred to as the Taylor cone (G. I. Taylor. *Disintegration of water drops in an electric field*. Proc. R. Soc. Lon. A 280, 383-397, 1964). The thin jet eventually breaks up into a stream of highly charged droplets with a diameter of the order of d. This electrohydrodynamic steady-state process is so-called steady cone-jet electrospray (M. Cloupeau, B. Prunet-Foch. *Electrostatic spraying of liquids in cone-jet mode*. J. Electrost. 22, 135-159, 1989), or just electrospray (C. Pantano, A. M. Gañán-Calvo, A. Barrero. *Zeroth-order electrohydrostatic solution for electrospraying in cone jet mode*. J. Aerosol Sci. 25, 1065-1077, 1994).

The electrospray has been applied for bioanalysis (J. B. Fenn, M. Mann, C. K. Meng, S. K. Wong, C. Whitehouse C. *Electrospray ionization for mass spectrometry of large biomolecules*. Science 246, 64-71, 1989), fine coatings (W. Siefert. *Corona spray pyrolysis: a new coating technique with an extremely enhanced deposition efficiency*. Thin Solid Films 120, 267-274, 1984), synthesis of powders (A. J. Rulison, R. C. Flagan. *Synthesis of Yttrya powders by electrospray pyrolysis*. J. Am. Ceramic Soc. 77, 3244-3250, 1994), and electrical propulsión (M. Martínez-Sánchez, J. Fernández de la Mora, V. Hruby, M. Gamero-Castaño M, V. Khayms. *Research on colloidal thrusters*. Proc. 26th Int. Electr. Propuls. Conf., Kitakyushu, Jpn., pp. 93-100. Electr. Rocket Propuls. Soc. 1999), among other technological applications. Recently, electrosprays in cone-jet mode were also performed inside dielectric liquid baths to produce fine emulsions (A. Barrero, J. M. Lóopez-Herrera, A. Boucard A, I. G. Loscertales, M. Marquez. *Steady cone-jet electrosprays in liquid insulator baths*. J. Colloid Interface Sci. 272, 104-8, 2004).

In electrosprays, a flow rate q of a liquid with electrical conductivity K is fed through a capillary tube of diameter $D_t$ connected to an electrical potential V with respect to a grounded electrode. Given a liquid and a geometrical configuration of the tube-grounded electrode an electrospray forms at the end of the tube for a certain range of values of both q and V. Within this range, the effect of both the voltage V and the electrode geometry on either the current I transported by the jet or its diameter d is almost negligible for most experimental conditions, leaving the flow rate q as the main controlling parameter. Furthermore, the liquid viscosity $\mu$ affects only the jet breakup, but neither I nor d. For a given liquid one has: $d=d_o\ f(\beta,q/q_o)$ and $I=I_o\ g(\beta,q/q_o)$, where $d_o=[\gamma\epsilon_o^2/(\rho K^2)]^{1/3}$, $q_o=\gamma\epsilon_o/(\rho K)$, $\epsilon_o$ and $\beta$ are the vacuum permittivity and the dielectric constant of the liquid respectively, and functions f and g must be experimentally determined.

Experimental and numerical studies on the scaling law of I have provided the widely accepted relationship, $I=g(\beta)(\gamma Kq)^{1/2}$, with $g(\beta)\sim\beta^{1/4}$ (J. Fernández de la Mora & I. G. Loscertales. *The current emitted by highly conducting Taylor cones*. J. Fluid Mech. 260, 155-184, 1994; A. M. Gañán-Calvo, J. Dávila, A. Barrero. *Current and droplet size in the electrospraying of liquids. Scaling laws*. J. Aerosol Sci. 28, 249-275, 1997.)

However, the scaling law for the jet diameter d remains still controversial because experimental errors in the reported measurements of the mean droplet size do not allow the distinction between the different proposed size laws. The scaling size laws that appear most frequently in the literature can be cast in the form, $d\sim f(\beta)\ d_o(q/q_o)^n$, where $f(\beta)\sim 1$ and n takes the values ⅓, ½, and ⅔, depending on the authors.

For electrosprays, experimental data and scaling laws show that the minimum jet diameter that can be achieved is of the order of one micron for liquids with electrical conductivities of the order of $10^{-3}$ S/m, but if K takes values of the order of 1 S/m, then $d_{min}$ becomes of the order of 10 nanometers.

(ii) Electrospinning.

The electro-hydrodynamic flow described above can also be used to obtain very thin fibers if the jet solidifies before breaking into charged droplets. This process, known as electrospinning, occurs when the working fluid is a complex fluid, such as the melt of polymers of high molecular weight dissolved in a volatile solvent (J. Doshi & D. R. Reneker. *Electrospinning process and applications of electrospun fibers*. J. Electrost. 35, 151-160, 1995; S. V. Fridrikh, J. H. Yu, M. P. Brenner, G. C. Rutledge. Controlling the fiber diameter during electrospinning. *Phys. Rev. Lett.* 90, 144502, 2003). The rheological properties of these melts, sometimes enhanced by the solvent evaporation from the jet, slow down and even prevent the growth of varicose instabilities. As is well-known, large values of liquid viscosity delay the jet breakup by reducing the growth rate of axisymmetric perturbations, so longer jets may be obtained. However, non-symmetric perturbation modes can also grow due to the net charge carried by the jet. Indeed, if a small portion of the charged jet moves slightly off axis, the charge distributed along the rest of the jet will push that portion farther away from the axis, thus leading to a lateral instability known as whipping or bending instability. A picture capturing the development of the whipping instability in a jet of glycerin in a hexane bath is shown in FIG. 4.

The chaotic movement of the jet under this instability gives rise to very large tensile stresses, which lead to a dramatic jet thinning. The solidification process, and thus the production of micro- or nanofibers, is enhanced by the spectacular increase of the solvent evaporation rate due to the thinning process. For the production of nanofibers, this technique is very competitive with other existing ones (i.e., phase separation, self-assembly, and template synthesis, among others), and is therefore the subject of intense research.

(D) Steady-State Coaxial Capillary Flows for Core-Shell Micro and Nanoparticles

Micro and nanoparticles with a well-defined core-shell structure may also be obtained from flows obeying the same basic principles as those reviewed in the previous section; in this case, however, two interfaces separating three fluid media are required to produce the core-shell structure. The motion of the liquids must result in a coaxial stretching of the two interfaces and the breakup of the interfaces in this coaxial configuration may lead to core-shell particles. For instance, either core-shell capsules or fibers can be obtained from a coaxial jet, depending on whether the jet breaks or solidifies, respectively. These types of coaxial flows are governed by twice the number of parameters as those described previously, and so may exhibit many more regimes. However, when seeking the steady-state condition, the possible regimes are limited.

(i) Hydrodynamic Focusing in Fluidic Devices.

Utada et al. (2005) introduced a fluidic device based on hydrodynamic focusing that generates double emulsions in a single step in the micrometric range (A. S. Utada, E. Lorenceau, D. R. Link, P. D. Kaplan, H. A. Stone, D. A. Weitz. *Monodisperse double emulsions generated from a microcapillary device*. Science 308, 537-54, 2005). In their device, sketched in FIG. 5, three immiscible fluids are forced through a converging exit orifice. The converging flow of the outer fluid stretches out the two interfaces between the fluid media whose breakup by capillary instabilities forms core shell drops.

In steady-state conditions, two operative regimes, dripping or jetting, may be established. Dripping produces drops close to the entrance of the collection tube within a single orifice diameter, analogous to a dripping faucet. In contrast, jetting produces a coaxial jet that extends three or more orifice diameters downstream into the collection tube, where it breaks into drops. For a given dripping condition, an increase of the flow rate of the focusing fluid (the outermost) beyond a threshold value causes the interface to abruptly lengthen, defining the transition to the jetting regime. Droplets produced by dripping are typically highly monodisperse, whereas the jetting regime typically results in polydisperse droplets whose radii are much greater than that of the jet. However, these authors discovered a very narrow window of operational conditions in which jetting yields a monodispersity similar to that of dripping. The size distribution of the double emulsions is determined by the break-up mechanism, whereas the number of innermost droplets (i.e., core-shell or multivesicles capsules) depends on the relative rates of drop formation of the inner and middle fluids. When the rates are equal, the annulus and core of the coaxial jet break simultaneously, generating a core-shell drop.

(ii) Electrified Coaxial Jet.

Particles with core-shell structure were recently obtained from electrified coaxial jets with diameters in the nanometer range (I. G. Loscertales, A. Barrero, I. Guerrero, R. Cortijo, M. Márquez, A. Ganan-Calvo. *Micro/nano encapsulation via electrified coaxial liquid jets*. Science 295, 1695-1698, 2002). In this technique, two immiscible liquids are injected at appropriate flow rates through two concentrically located capillary needles. At least one of the needles is connected to an electrical potential relative to a ground electrode. The needles are immersed in a dielectric host medium that may be gas, liquid, or vacuum. For a certain range of values of the electrical potential and flow rates, a compound Taylor cone is formed at the exit of the needles, with an outer meniscus surrounding the inner one (see FIG. 6*a*). A liquid thread is issued from the vertex of each one of the two menisci, giving rise to a compound jet of two co-flowing liquids (see FIG. 6*b*). To obtain this compound Taylor cone, at least one of the two liquids must be sufficiently conducting. Similarly to simple electrosprays, the electrical field pulls the induced net electric charge located at the interface between the conducting liquid and a dielectric medium and sets this interface into motion; because this interface drags the bulk fluids, it may be called the driving interface. The driving interface may be either the outermost or the innermost one; the latter happens when the outer liquid is a dielectric. When the driving interface is the outermost, it induces a motion in the outer liquid that drags the liquid-liquid interface. When the drag overcomes the liquid-liquid interfacial tension, a steady-state coaxial jet may be formed. On the other hand, when the driving interface is the innermost, its motion is simultaneously diffused to both liquids by viscosity, setting both in motion to form the coaxial jet.

Scaling laws showing the effect of the flow rates of both liquids on the current transported by these coaxial jets and on the size of the compound droplets were recently investigated (J. M. López-Herrera, A. Barrero, I. G. Loscertales, M. Márquez. *Coaxial jets generated from electrified Taylor cones. Scaling laws*. J. Aerosol Sci. 34, 535-552, 2003). This technique has been used to generate, upon coaxial jet breakup, core-shell micro- and nanocapsules and microemulsions (G. Larsen G, R. Velarde-Ortiz, K. Minchow, A. Barrero, I. G. Loscertales. *A method for making inorganic and hybrid (organic/inorganic) fibers and vesicles with diameters in the submicrometer and micrometer range via sol-gel chemistry and electrically forced liquid jets*. J. Am. Chem. Soc. 125:1154-55, 2003; I. G. Loscertales, A. Barrero, M. Márquez, R. Spretz, R. Velarde-Ortiz, G. Larsen. *Electrically forced coaxial nanojets for one-step hollow nanofiber design*. J. Am. Chem. Soc. 126, 5376-5377, 2004; A. Barrero, J. M. López-Herrera, A. Boucard, I. G. Loscertales, M. Márquez. *Steady cone-jet electrosprays in liquid insulator baths*. J. Colloid Interface Sci. 272, 104-108, 2005).

It is important to point out that the mean size of the capsules may be submicronic in contrast to the technique described in the previous section. On the other hand, the size distributions are broader than those obtained there; nonetheless, polydispersities of 10% can be obtained. Similarly to electrospinning, solidification of the outer liquid leads to hollow nanofibers (Loscertales et al. 2004; D. Li D, Y. Xia. *Direct fabrication of composite and ceramic hollow nanofibers by electrospinning*, Nano Lett. 4, 933-938, 2004; M. Lallave, J. Bedia, R. Ruiz-Rosas, J. Rodriguez-Mirasol, T. Cordero, J. C. Otero, M. Marquez, A. Barrero, I. G. Loscertales, *Filled and hollow carbon nanofibers by coaxial electrospinning of Alcell lignin without binding polymers*, Adv. Mat. 19, 4292, 2007), whereas solidification of the two liquids leads to coaxial nanofibers (Z. Sun, E. Zussman, A. L. Yarin, J. H. Wendorff, A. Greiner. *Compound core-shell polymer nanofibers by co-electrospinning*. Adv. Mater. 15, 1929-1932, 2003; J. H. Yu, S. V. Fridrikh, G. C. Rutledge. *Production of submicrometer diameter fibers by two-fluid electrospinning*. Adv. Mater. 16, 1562-66, 2004; J. E. Díaz, A. Barrero, M. Márquez, I. G. Loscertales. *Controlled encapsulation of hydrophobic liquids in hydrophilic polymer nanofibers by electrospinning*. Advanced Functional Materials, 16, 2110-2116, 2006). This process has been termed coelectrospinning.

SUMMARY OF THE INVENTION

The present invention is related to a device and to a method for producing micro and nano-droplets in a microfluidic device that naturally forms an emulsion and that could also form other kind of suspensions. The invention exploits the combined action of both electric and hydrodynamic forces to produce emulsions of droplets with a mean diameter, that are much smaller than the mean diameter of the droplets obtained in conventional micro-fluidic devices, such as those described in the background art. A crucial novelty of the invention relies on the use of a flowing liquid collector, which allows the application of the electric forces and enables the extraction and discharge of the resultant droplets. The flexibility of the method provides a way to produce simple and multiple emulsions based on immiscible liquids within a broad range of liquid properties, and a particle suspensions obtained after droplet solidification.

Existing microfluidic technology uses solely pure hydrodynamic forces to generate droplets; although some implementations apply electric fields, the electric forces are used only to manipulate droplets that are previously formed in the device (see D. Link et al., *Electronic control of fluidic species*, US 20070003442A1), but never to generate them. On the other hand, the electrostatic atomization process for producing fine droplets within dielectric liquid baths has never been performed in combination with hydrodynamic forces (co-flow), or in microfluidic devices (see A. Barrero et al., *Electrohydrodynamic device and method for the generation of nanoemulsions*, PCT/ES2006/000220; A. G. Marin, I. G. Loscertales, M. Márquez, A. Barrero. *Simple and double emulsions via coaxial jet electrosprays*. Phys. Rev. Lett. 98, 014502, 2007). The simultaneous combination of the two aforementioned forces in a microfluidic device to form droplets will open up a domain of the droplet diameter range in which the atomization process may be performed, which is neither covered by solely the co-flowing nor solely by the electrospray operational ranges (D. R. Link et al. (2004), *Geometrically mediated break up of drops in microfluidic devices*, Phys. Rev. Lett. 92, 054503; J. B. Knight et al. (1998) *Hydrodynamic focusing on a silicon chip: mixing nanoliters in nanoseconds*, Phys. Rev. Lett. 80, 3863; S. L. Anna et al. (2003), *Formation of dispersions using "flow focusing" in microchannels*, Appl. Phys. Lett. 82, 364; A. S. Utada et al. (2005), *Monodisperse double emulsions generated from a microcapillary device*, Science 308, 537; A. Barrero & I. G. Loscertales (2007) *Micro-and nanoparticles via capillary flows, Ann. Rev. Fluid Mech.* 39, 89). For the case of electrospray (ES) in liquid baths the drop size can reach the submicron scale if liquids of sufficiently high electrical conductivity are used (A. Barrero et al. (2004) *Steady cone jet electrospray in insulator liquid baths*, J. Coll. Interf. Sci. 272, 104; A. G. Marín et al. (2007) *Simple and double emulsions via electrospray*, Phys. Rev. Lett. 98, 014502-1). However, if the electrical conductivity of the liquid is in the order of $10^{-1}$ S/m or higher, it becomes impossible to produce droplets of diameters well above few hundred nanometers by solely the action of the electric forces.

A recent invention (A. M. Gañáan-Calvo & J. M. Lopez-Herrera Sanchez (2008) Device for the production of capillary jets and micro- and nanometric particles, U.S. Pat. No. 7,341,211 B2) proposes the concatenated combination of the hydrodynamic and electric forces since, as explained in the Summary of the Invention of that patent, "the micro jet and the spray are produced by an electric process and then are efficiently sucked away by flow-focusing effect", and also "a solution is disclosed allowing the combination of electrostatic forces acting on the liquid with mechanical forces extracting the spray through the electrode"; according to the inventors, this is done to increase the droplet production-rate of electrosprays, using a somewhat specific electrode geometry.

When the electric forces are one of the leading forces driving the droplet formation process, the droplets thus formed are highly charged, and the corresponding aerosol generates intense space-charge effects. The intense electric self-repulsion due to the space-charge strongly pushes the droplets apart from each other, driving them towards the walls of the device where they accumulate and coalesce, thus making the aerosol extraction process impossible unless the charge on the droplets is neutralized. This problem severely limits some applications of atomization devices based on electro-hydrodynamic forces.

In the present invention, a standard microfluidic device simultaneously combines electric and hydrodynamic forces to form and to control the diameter of the jet, which produces the droplets after its breakup; the procedure incorporates a liquid electrode to neutralize the droplets allowing steady extraction of them. The three key aspects of the invention are:

(i) The use of a steady liquid-liquid interface formed by two flowing immiscible fluids (the dielectric fluid and the liquid collector), in clear contrast with the descriptions in A. Barrero et al. (2004) and A. G. Marín et al. (2007). The presence of this interface solves the well-known and often overlooked problem of the intense space charge resulting from the extremely low mobility of highly charged droplets in fluid media. Unless this space charge is reduced, the continuous drop accumulation near the electrified meniscus would prevent any steady-state operation of the device. In addition, allowing the micro- or nano-droplets to release their charge on the liquid collector interface not only reduces the space charge but also stabilizes the resulting micro- or nano-emulsion allowing a steady-state emulsification process. This is why this aspect of the present invention is essential.

As mentioned before, when the concentration of low mobility and highly charged droplets moving in a liquid media is large, the electric self-repulsion will rapidly push them towards the walls of the microfluidic device, where they accumulate and coalesce. In the case of a solid collector, the micro- or nano-droplets (which are much smaller than the device cross-section) would stick onto the collector after releasing their charge. Since the fluid velocity vanishes at the solid walls, including the collector walls, the hydrodynamic drag in the close vicinity of the collector is unable to sweep the micro- or nano-droplets away from it. As a result, the droplets accumulate and eventually coalesce if the droplet concentration surpasses a certain critical value. The same would happen when the droplets accumulate on the walls of the device, even if the walls of the channel were electrically conducting.

In the present invention the charged droplets give up their charge as they reach the dielectric-conducting liquid interface, thus forming a neutral emulsion either within the dielectric liquid or within the liquid collector, depending on whether the droplets cross or do not cross the interface, but in either case far from solid walls. Since the liquid collector and dielectric liquid flow along the interface towards the exit of the device through the gap between the capillaries, the emulsion droplets are carried away with them, allowing for the steady state operation of the device. By contrast, if there were no fluid motion, the droplet concentration on the dielectric-conducting liquid interface would continuously increase, eventually reaching some critical value above which droplet coalescence or other undesirable effects would happen preventing the steady-state operation of the device.

(ii) The simultaneous combination of electric and hydrodynamic forces to form and to control a steady state jet and the droplets resulting from its break up. This aspect allows:

(a) Reducing the size of the generated droplets or particles compared to those that would be obtained in the presence of only hydrodynamic forces.

(b) Increasing the size of the generated droplets or particles compared to those that would be obtained by solely electric forces (i.e. electrosprays) of highly conducting liquids.

(iii) Using standard microfluidic devices to simultaneously combine electric and hydrodynamic forces to produce capillary electrified jets within a dielectric fluid in a steady-state manner.

Note that with the present invention the fluid where the emulsion is formed may either be the dielectric liquid or the liquid collector, since in either case the droplets are discharged and swept away in a steady-state manner. In addition, by generating a coaxial jet of two liquids, we can produce water-in-oil or oil-in-water micro- and nano-emulsions in a steady state process.

Using these devices, the generated emulsions can be easily transformed into particle suspensions. The strategy is based on using the inner and coating liquids as carriers of the desired precursors. The inner liquid can act as carrier for all particle precursors, while the coating liquid can act as carrier for the initiator of the solidification reaction, and vice-versa. Additionally, one can incorporate different precursors in each stream and induce the solidification process using light as a trigger. Since these two streams are separated apart, the reaction can only start after the double emulsion drop is formed; at this point the components mix, which typically takes about 100 ms (J-W. Kim, A. S. Utada, A. Fernandez-Nieves, Z. Hu, D. A. Weitz, *Fabrication of monodisperse gel shells and functional microgels in microfluidic devices*, Angew. Chem. Int. Ed. 46, 1819, 2007), and subsequently the drop becomes a solid particle, which can take times as low as 10 seconds. This time scale allows the solidification of the drop prior to its collection, which guarantees the lack of drop-drop coalescence, which will severely limit the monodispersity of the resultant suspension. Our method provides a unique way to generate suspensions in a wide size range, de-coupling the particle properties, which can be tuned by using the desired precursors, and suspension monodispersity, which is controlled by the fluid mechanics of the generation process.

Finally, the present invention allow for an easy multiplexation in order to increase the production rates. Indeed, it could be incorporated a multi-injector with many injection needles arranged in a honey-comb pattern, for example, into any of the suggested devices; each tip in the injector can simply be based on a single capillary or on a compound and concentric capillary. The multiplexation of electrosprays has been achieved in the absence of a co-flowing liquid using injection needles (W. Deng, J. F. Klemic, X. Li, M. A. Reed, A. Gomez, *Increase of electrospray throughput using multiplexed microfabricated sources for the scalable generation of monodisperse droplets*, J. Aerosol Sci. 37, 696-714, 2006; A. Gomez, J. F Klemic, W. Deng, X. Li, M. A. Reed (2006), Increase of electrospray throughput using multiplexed microfabricated sources for the scalable generation of monodisperse droplets, WO/2006/009854) and injection holes (R. Bocanegra, D. Galán, M. Márquez, I. G. Loscertales, A. Barrero, *Multiple electrosprays emitted from an array of holes*, J. Aerosol Sci. 36, 1387-1399, 2005), and only in the presence of coflowing liquid, without the application of electric forces (A. G. Marin, F. Campo-Cortes, J. M. Gordillo, *Generation of micron-sized drops and bubbles through viscous coflows*, Colloids and Surfaces A, accepted). In this case also, the superposition of both force fields extends the flexibility and capability of the drop generation procedure, allowing the fabrication of emulsions and particle suspensions with a narrow size distribution over a wide size range.

Throughout the description and claims the word "comprise" and variations of the word, are not intended to exclude other technical features, components, or steps. Additional objects, advantages and features of the invention will become apparent to those skilled in the art upon examination of the description or may be learned by practice of the invention. The following examples and drawings are provided by way of illustration, and they are not intended to be limiting of the present invention. Furthermore, the present invention covers all possible combinations of particular and preferred embodiments described herein.

DETAILED DESCRIPTION OF PARTICULAR EMBODIMENTS

Figure 1:
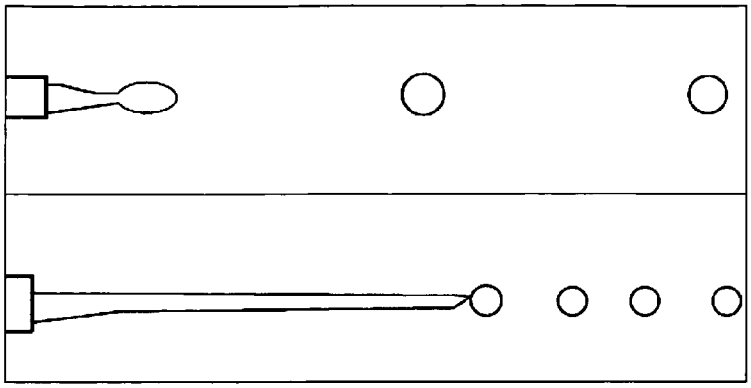
FIG. 1. Shows a picture depicting the (A) dripping mode; and (B) the jetting mode described in the prior art.
Figure 2:
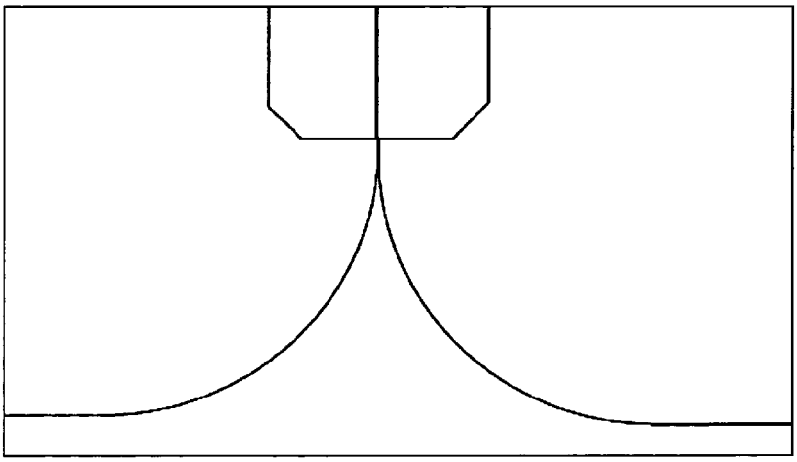
FIG. 2. Shows a picture depicting the selective withdrawal as it is described in the prior art.
Figure 3:
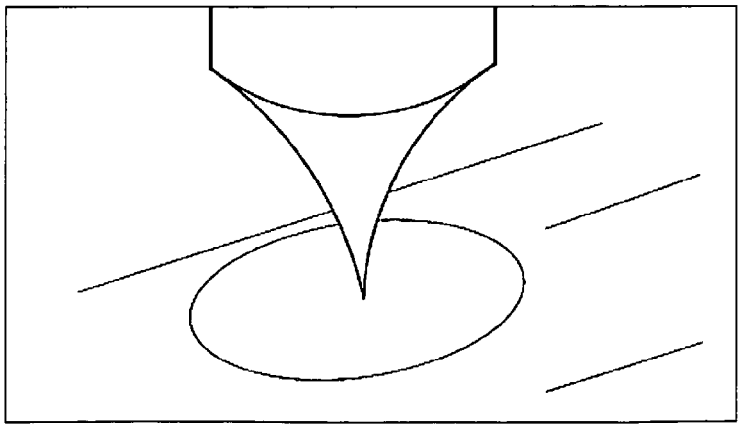
FIG. 3. Shows a picture depicting the flow focusing, as it is described in the prior art.
Figure 4:
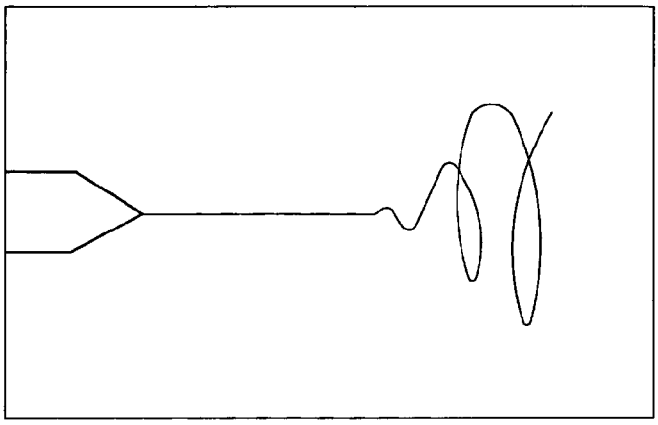
FIG. 4. Shows a picture depicting whipping instability of an electrified jet of glycerin in a bath of hexane, as it is described in the prior art.
Figure 5:
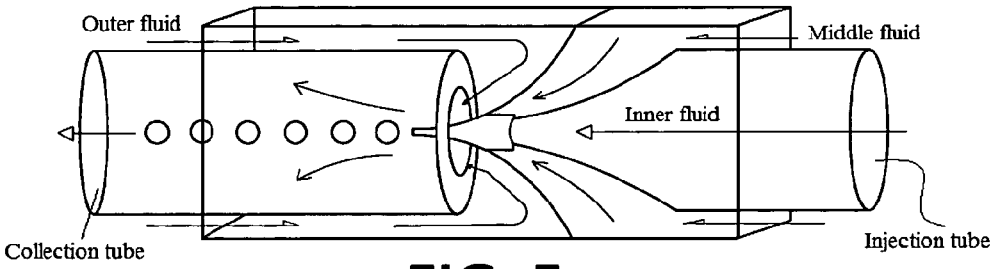
FIG. 5. Shows a schematic view of a device for generating double emulsions from coaxial jets, as it is described in the prior art.
Figure 6:
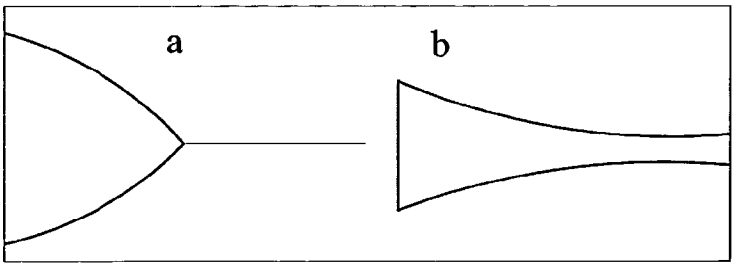
FIG. 6. Shows a picture depicting (A) a compound Taylor cone; and (B) a detail of coaxial jet, as it is described in the prior art.

As can be shown in the attached figures, the invention consists on an electro-fluidic device to produce emulsions and particle suspensions comprising a capillary (1,1',101, 101') immersed in a dielectric fluid (2,102) that flows along a micro-channel (3,103); said dielectric fluid (2,102) being immiscible or poorly miscible with a first conducting fluid (8,8',108,108') and a second conducting fluid (5,105,105'); wherein said second conducting fluid flows through a second capillary (4,104,104') immersed in the dielectric fluid (1,102); said device characterized in that said second conducting fluid (5,105,105') is pumped counter-flow with respect to the dielectric fluid (2,102) and a steady state interface (6,6',106,106',116,116') is formed; and wherein a steady capillary jet is formed when an appropriate electrical potential difference (9,109) is applied to said conducting fluids, producing a stream of charged droplets (11,111) which move towards the steady state interface (6,6',116,116') under the combined action of the electric and hydrodynamic forces; and wherein once the droplets (11,111) reach the steady state interface (6,6',116,116') they discharge and form an emulsion that leaves through a gap (7,107).

In a second aspect of the invention, the method to produce emulsions and particle suspensions, characterized in that it comprises the steps of: (i) immersion of a capillary (1,1', 101,101') in a dielectric fluid (2,102) that flows along a micro-channel (3,103); said dielectric fluid (2,102) being immiscible or poorly miscible with a first conducting fluid (8,8',108,108') and a second conducting fluid (5,105,105'); and wherein said second conducting fluid flows through a second capillary (4,104,104') immersed in the dielectric fluid (1,102); (ii) pumping counter-flow said second conducting fluid (5,105,105') with respect to the dielectric fluid (2,102) and forming a steady state interface (6,6',106,106', 116,116'); and (iii) applying an appropriate electrical potential difference (9,109) to said conducting fluids, producing a stream of charged droplets (11,111) which move towards the steady state interface (6,6',116,116') under the combined action of the electric and hydrodynamic forces; and wherein once the droplets (11,111) reach the steady state interface (6,6',116,116') they discharge and form an emulsion that leaves through a gap (7,107).

Finally in other aspect of the invention, the system to produce emulsions and particle suspensions comprises the aforementioned device or means to perform the above described method.

If the liquid forming the micro or nano-droplets carries material or species that may become solid upon a suitable stimulus (i.e. polymerization, phase transition, etc.), then a suspension may be formed.

Figure 7:
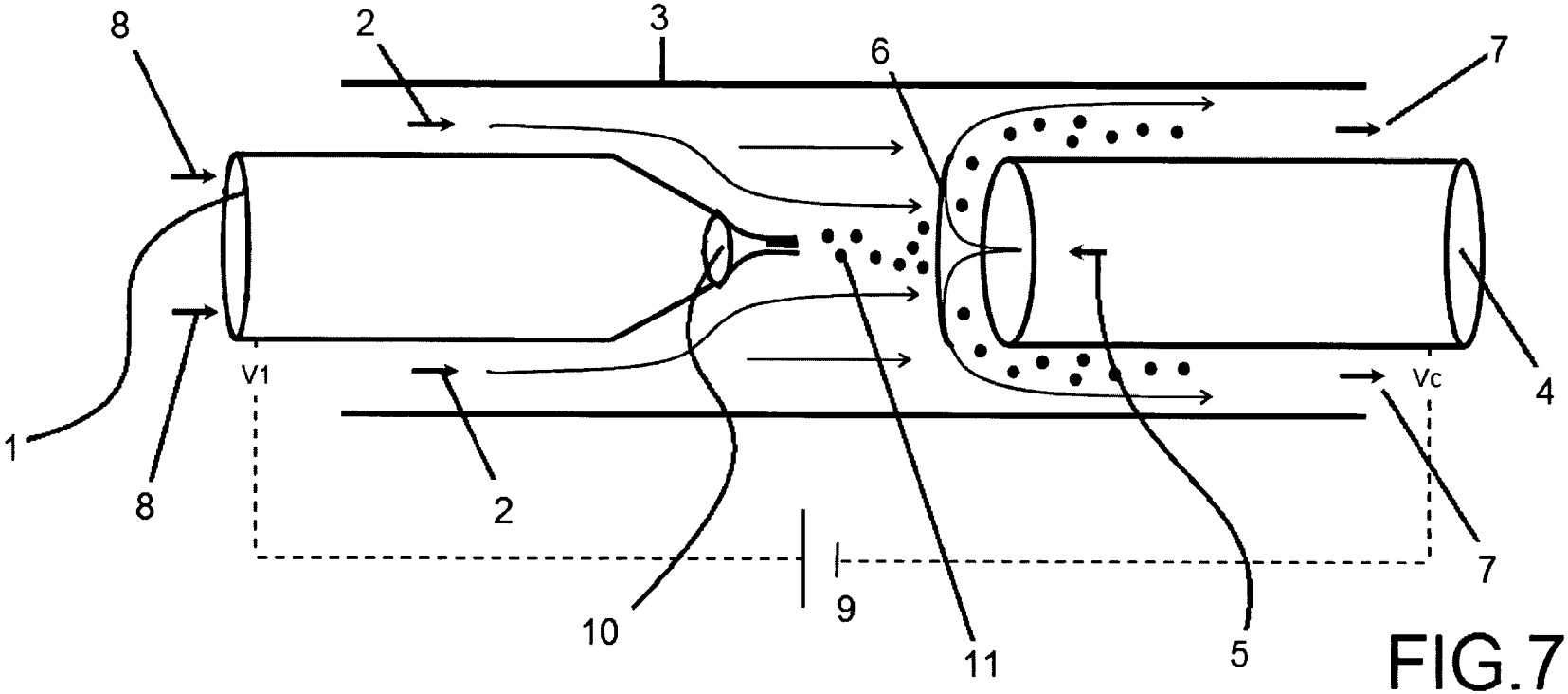
FIG. 7. Shows a schematic view of the micro-fluidic device to produce emulsions and particle suspensions, object of the present invention, in its first embodiment.

More concretely, in a first embodiment of the invention, as can be shown in FIG. 7, the electro-fluidic device to produce emulsions and particle suspensions, object of the present invention comprises a first feeding tip (the first capillary tip 1) such that, through the first feeding tip 1 flows an inner conducting liquid 8 at a flow rate $Q_1$. Said first feeding tip 1 is immersed in a dielectric liquid 2 immiscible or poorly miscible with said inner conducting liquid 8 at a rate $Q_D$. On the other hand, the device also comprises a second feeding capillary tip 4 located in front of the first feeding tip 1 and immersed in the dielectric liquid 2, such that a conducting liquid or liquid collector 5, immiscible or poorly miscible with the dielectric liquid 2 counter-flows through the second feeding capillary tip 4 against the dielectric liquid 2 at a rate $Q_C$, such that a steady state interface 6 separating the dielectric liquid 2 and the inner conducting liquid 8 is formed somewhere in between the first and second capillary tips (1,4).

The inner conducting liquid 8 forms an electrified capillary meniscus 10 of the inner conducting liquid 8 at the exit of the first feeding tip 1 whenever the first and second capillary tips (1,4) are both connected respectively to potential $V_1$ and $V_C$ with respect to a reference electrode.

A steady state capillary jet of inner conducting liquid 8 issues from the first capillary tip 1, such that its diameter, which can be smaller, comparable or larger than the characteristic diameter of the first capillary tip 1 has a value comprised between 10 nanometers and 100 microns. The spontaneous breakup of the capillary jet produces droplets 11 of the inner conducting liquid 8 which move towards the steady state interface 6 under the combined action of electric forces and the drag exerted by the moving dielectric liquid 2. The droplets 11 release most of their electrical charge upon reaching the steady state interface 6, then being dragged out of the device by the motion of the dielectric liquid 2 and the conducting liquid 5.

The diameter of the first and second capillary tips (1,4) are preferably comprised between 0.001 mm and 5 mm in the present embodiment.

The flow rate $Q_1$ between the inner conducting liquid 8 and the first capillary feeding tip 1 is preferably comprised between $10^{-15}$ $m^3/s$ and $10^{-7}$ $m^3/s$. Otherwise, the flow rate $Q_D$ of the dielectric liquid 2 and the flow rate $Q_C$ of the conducting fluid 5 have respectively a value between 0 and $10^{-1}$ $m^3/s$.

Also, in this embodiment of the invention, the dielectric conductivity of the inner conducting liquid 8 and the conducting liquid 5 varies between $10^{-12}$ and $10^6$ S/m.

In this embodiment, for obtaining a separation between the first feeding tip 1 and the steady state interface 6 of a value between 0.001 mm and 10 cm, the absolute value of the electric potential difference ($V_1$–$V_C$) has to be comprised between 1 V and 100 kV.

In this first embodiment, the dielectric liquid 2 can be substituted by a gas. Finally, the inner conducting liquid 8 is such that the droplets 11 can be post-processed to become solid.

Figure 8:
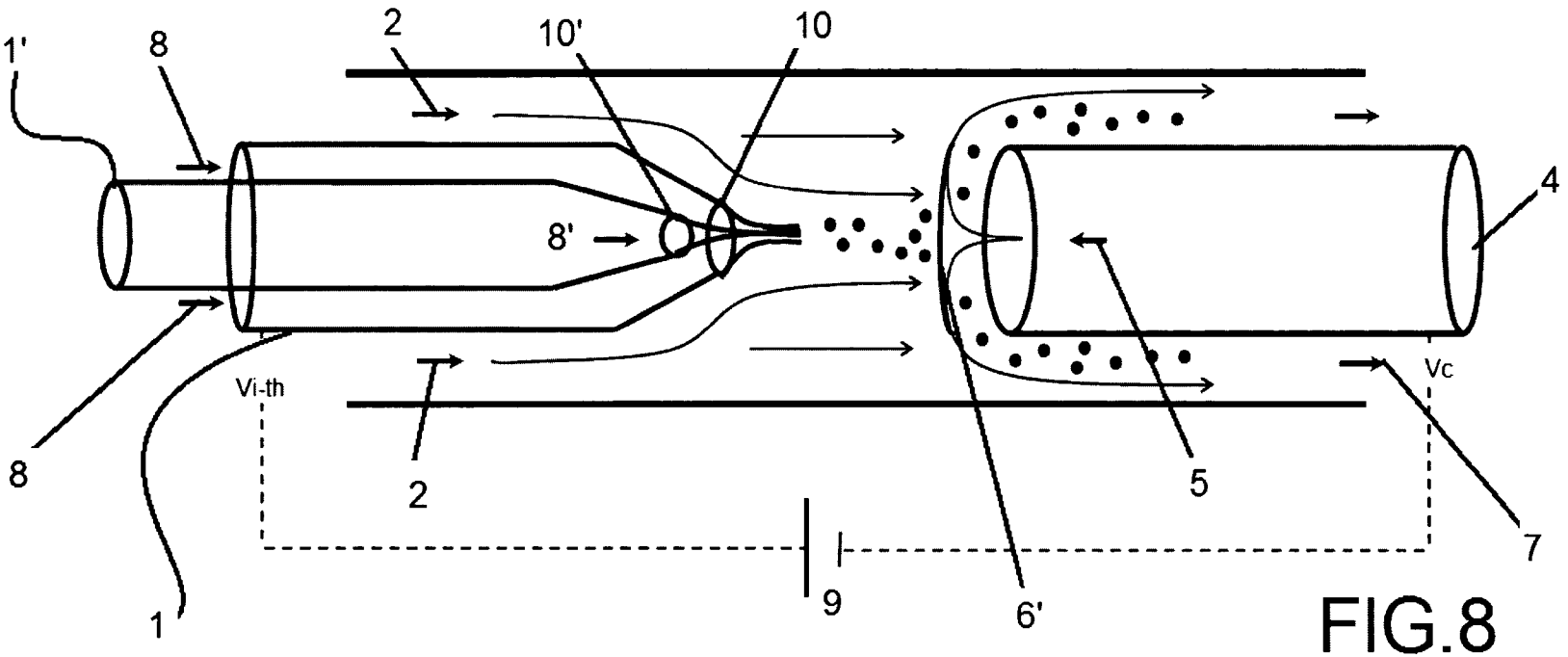
FIG. 8. Shows a schematic of a micro-fluidic device for the steady generation of emulsions under the simultaneous combined action of electric and hydrodynamic forces, object of the present invention in its second embodiment.

In a second embodiment of the invention, as can be shown in FIG. 8, the device comprises of a number N of feeding tips (1,1') with (N≥2). In this embodiment, the first capillary tip 1 flows an inner conducting liquid 8 at a flow rate $Q_1$ whilst a generic conducting liquid Li-th flows at a generic flow rate $Q_i$ through the Ti-th tip (2≤i≤N); in FIG. 8, the inner conducting liquid 8' flows through the capillary tip 1' at a flow rate $Q_1'$ for N=2; and wherein the N feeding tips (1,1') are arranged such that the L(i−1)-th conducting fluid surrounds the Ti-th tip and the tips (1,1'), that are immersed in a dielectric liquid 2 immiscible or poorly miscible with said inner conducting liquid 8, which is co-flowing with said conducting liquid 8 at a rate $Q_D$.

On the other hand, the device also comprises a second feeding capillary tip 4 located in front of the first feeding tip 1 and immersed in the dielectric liquid 2, such that a conducting liquid or liquid collector 5, immiscible or poorly miscible with the dielectric liquid 2 counter-flows through the second feeding capillary tip 4 against the dielectric liquid 2 at a rate $Q_C$, such that a steady state interface 6' separating the dielectric liquid 2 and the inner conducting liquid (8,8') is formed somewhere in between the first and second capillary tips (1,4).

Each of the N inner conducting liquids Li-th forms a meniscus (10,10') at the exit of its respective feeding tip (1,1') whenever the second capillary tip 4 and each Ti-th feeding tips are respectively connected to electrical potentials $V_C$ and $V_{i\text{-}th}$ with respect to a reference electrode 9.

A steady state compound jet, such that the liquid L(i−1)-th surrounds the Li-th one, is formed from the N jets that issue from each of the N feeding tips and such that the diameter of the compound capillary jet has a value between 10 nanometers and 100 microns. The spontaneous breakup of the compound capillary jet produces compound droplets 11 with N layers such that the L(i−1)-th liquid surrounding the Li-th one, which move under the combined action of electric forces and the drag exerted by the moving dielectric liquid 2 towards the steady state interface 6' where the compound droplets release most of their charge, then being dragged out of the device by the motion of the dielectric liquid 2 and the conducting liquid 5.

In the second embodiment, the diameter of the first feeding capillary tip 1 and the N feeding capillary tips 1' are preferably comprised between 0.001 mm and 5 mm.

The flow rate $Q_{i\text{-}th}$ of the liquid Li-th flowing through the feeding tip Ti-th is preferably comprised between $10^{-15}$ $m^3/s$ and $10^{-7}$ $m^3/s$. Otherwise, the flow rate $Q_D$ of the dielectric liquid 2 and the flow rate $Q_C$ of the conducting fluid 5 have respectively a value between 0 and $10^{-1}$ $m^3/s$.

Also, in this embodiment of the invention, the dielectric conductivity of the inner conducting liquid (8,8') and the conducting liquid 5 varies between $10^{-12}$ and $10^6$ S/m.

In the second embodiment, for obtaining a separation between the first feeding tip 1 and the steady state interface (6,6') of a value between 0.001 mm and 10 cm, the absolute value of the electric potential difference 9 ($V_1-V_C$) has to be comprised between 1 V and 100 kV.

In the second embodiment, the dielectric liquid 2 can be substituted by a gas. Similarly, at least one of the Li-th liquids (2≤i≤N) could be substituted by a gas. Finally, the inner nature of Li-th liquids is such that the droplets 11 can be post-processed to become solid.

Figure 9:
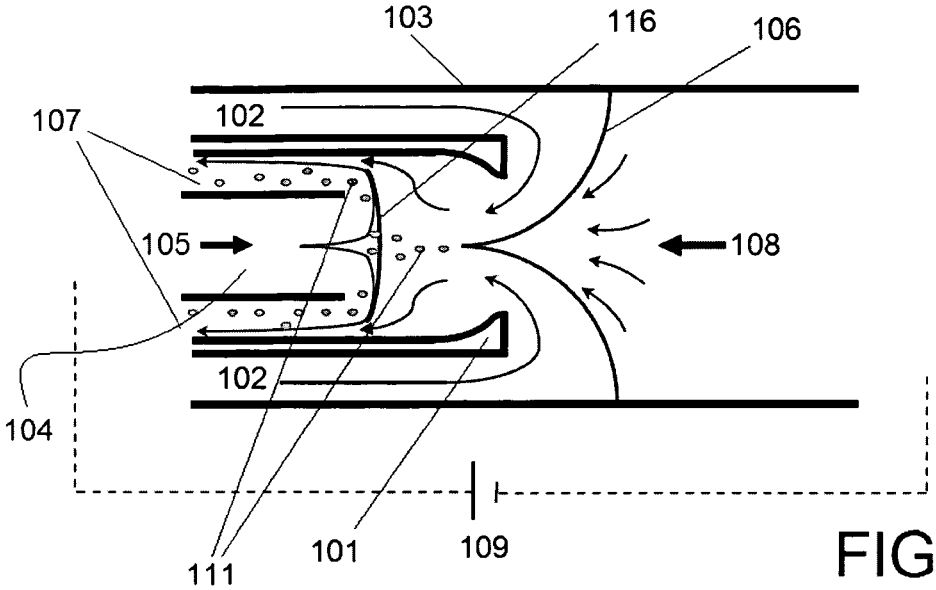
FIG. 9. Shows a schematic of a third embodiment of a micro-fluidic device for the steady generation of emulsions under the simultaneous combined action of electric and hydrodynamic forces.

In a third embodiment of the invention, showed in FIG. 9, the device object of the invention comprises a first conducting liquid 108 flowing at a rate $Q_0$ and a dielectric liquid 102 that flows along a micro-channel 103, immiscible or poorly miscible with the first conducting liquid 108, which is flowing against liquid 108 at a flow rate $Q_D$ such that a steady state interface 106 separating conducting liquid 108 and dielectric liquid 102 is formed.

A capillary 101 immersed in dielectric liquid 102 is located close to the steady state interface 106, sucks a flow rate $Q_D$ of dielectric liquid 102. Otherwise, a feeding capillary 104 is located inside capillary 101 and immersed in dielectric liquid 102, such that a conducting liquid 105, immiscible or poorly miscible with dielectric liquid 102, flows through the feeding capillary 104 against dielectric liquid 102 at a rate $Q_C$, such that a steady state interface 116 separating dielectric fluid 102 and conducting fluid 105 is formed somewhere inside capillary 101.

The first conducting liquid 108 forms a steady capillary jet when conducting liquids 108 and 105 are connected respectively to electrical potentials $V_0$ and $V_C$ with respect to a reference electrode 109, such that the flow rates of liquids 108, 102 and 105 flowing through the gap 107 between capillaries 101 and 104 are $Q_0$, $Q_D$ and $Q_C$, respectively, such that the diameter of the jet has a value between 10 nanometers and 100 microns.

The spontaneous breakup of the capillary jet produces droplets 111 of liquid 108 which move towards the liquid interface 116 under the combined action of electric forces and the drag exerted by the moving dielectric liquid 102 being. The droplets 111 release most of their electrical charge upon reaching interface 116, then being dragged out of the device by the motion of liquids 102 and 105.

The diameter of the capillaries 101 and 104 are preferably comprised between 0.001 mm and mm in this fourth embodiment.

The flow rate of the liquid 108 is preferably comprised between $10^{-15}$ $m^3/s$ and $10^{-7}$ $m^3/s$. Otherwise, the flow rate $Q_D$ of the dielectric liquid 102 and the flow rate $Q_C$ of the liquid 105 have respectively a value between 0 and $10^{-1}$ $m^3/s$.

Also, in this third embodiment of the invention, the dielectric conductivity of the liquids 108 and 105 varies between $10^{-12}$ and $10^6$ S/m.

In this third embodiment, for obtaining a separation between interfaces 106 and 106' of a value between 0.001 mm and 10 cm, the absolute value of the electric potential difference 109 ($V_0-V_0$) has to be comprised between 1 V and 100 kV.

In this third embodiment, the dielectric liquid 102 can be substituted by a gas. Finally, the liquid 108 is such that the droplets can be post-processed to become solid.

Figure 10:
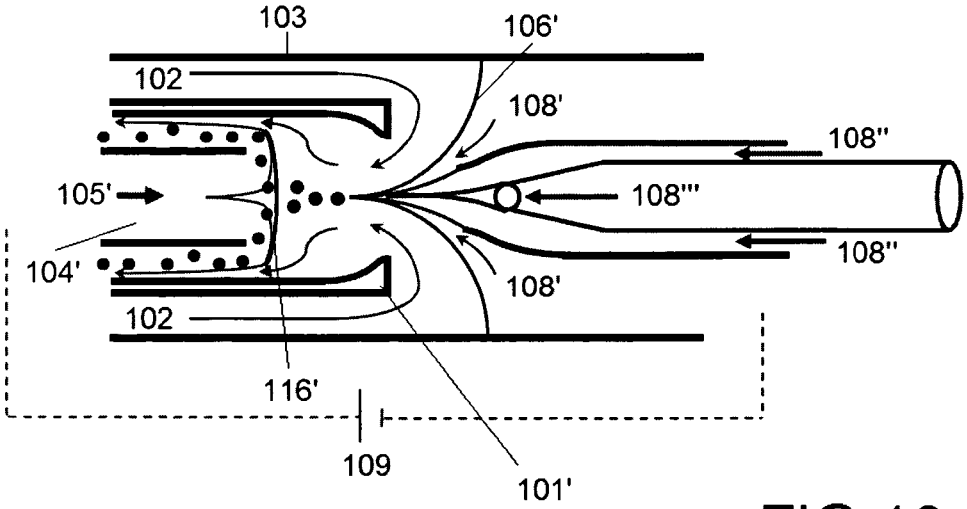
FIG. 10. Shows a schematic of a fourth embodiment of a micro-fluidic device for the steady generation of emulsions under the simultaneous combined action of electric and hydrodynamic forces, object of the present invention.

The fourth embodiment of the invention, that can be shown in FIG. 10, comprises a conducting liquid 108' flowing at a flow rate $Q_0$ and a dielectric liquid 102, immiscible or poorly miscible with liquid 108', which is flowing against liquid 108' at a flow rate $Q_D$ such that a steady state interface 106' separating liquids 108' and 102 is formed.

A number N of feeding tips (N≥1), such that a Li-th liquid 108" co-flows with liquid 108' at a flow rate $Q_i$ through the Ti-th tip (1≤i≤N) and the feeding tips are arranged such that the L(i−1)-th liquid (108",108'") surrounds the Ti-th tip and the tips are immersed in liquid 108'.

A capillary 101' is immersed in liquid 102, located close to the interface 106', sucks a flow rate $Q_D$ of dielectric liquid 102. Otherwise, a feeding capillary 104' is located inside capillary 101' and immersed in liquid 102, such that a conducting liquid 105', immiscible or poorly miscible with liquid 102, flows through 104' against liquid 102 at a rate $Q_C$, such that a steady state interface 116' separating fluids 102 and 105' is formed somewhere inside capillary 101'.

A steady compound capillary jet of conducting liquids (108',108", 108'"), such that liquid L(i−1)-th surrounds liquid Li-th, forms when liquids 108' and 105' are connected respectively to electrical potentials $V_0$ and $V_C$ with respect to a reference electrode 109, such that the flow rates of liquid Li-th (0≤i≤N), 102 and 105' flowing through the gap between capillaries 101' and 104' are $Q_i$, $Q_D$ and $Q_C$, respectively, such that the diameter of the jet has a value between 10 nanometers and 100 microns.

The spontaneous breakup of the compound jet produces compound droplets 111' with N layers such that the L(i−1)-th liquid surrounding the Li-th one, which move towards the liquid interface 116' under the combined action of electric forces and the drag exerted by the moving dielectric liquid 102. The compound droplets 111' release most of their electrical charge upon reaching interface 116', then being dragged out of the device by the motion of liquids 102 and 105'.

In fourth embodiment, the diameter of the 101', 104' and the N feeding capillary tips are preferably comprised between 0.001 mm and 5 mm.

The flow rate $Q_{i\text{-}th}$ of the liquid Li-th flowing through the feeding tip Ti-th and the liquid 108' is preferably comprised between $10^{-15}$ $m^3/s$ and $10^{-7}$ $m^3/s$. Otherwise, the flow rate $Q_D$ of the dielectric liquid 102 and the flow rate $Q_C$ of the fluid 105' have respectively a value between 0 and $10^{-1}$ $m^3/s$.

Also, in these embodiments of the invention, the dielectric conductivity of the liquids 108' and 105' varies between $10^{-12}$ and $10^6$ S/m.

In these embodiments, for obtaining a separation between interfaces 106' and 116' of a value between 0.001 mm and 10 cm, the absolute value of the electric potential difference 109 ($V_0$−$V_C$) has to be comprised between 1 V and 100 kV.

In these embodiments, the dielectric liquid D can be substituted by a gas. Similarly, at least one of the Li-th liquids (1≤i≤N) could be substituted by a gas. Finally, the nature of liquids Li-th is such that the droplets 111 can be post-processed to become solid.

The invention claimed is:

1. A system comprising:

a micro-channel having a central axis along its length;

a pump for pumping a dielectric fluid in a first flow direction within the micro-channel;

a first capillary tip located within the micro-channel and extending along the central axis of the micro-channel for a portion of the length of the micro-channel;

a pump for pumping a first conducting fluid in the first flow direction within the first capillary tip;

a second capillary tip located downstream in the first flow direction from the first capillary tip, the second capillary tip located within the micro-channel and extending along the central axis of the micro-channel for a portion of the length of the micro-channel;

an annular gap extending the length of the second capillary defined by the difference between the diameters of the micro-channel and the second capillary tip;

a pump for pumping a second conducting fluid in a second flow direction within the second capillary tip; and an electrical potential generator;

wherein the dielectric fluid is immiscible or poorly miscible with the conducting fluids;

wherein the second flow direction of the second conducting fluid flows counter with respect to the first flow direction of the dielectric fluid;

wherein upon flow of the dielectric, first and second fluids a steady state interface is formed separating the dielectric fluid and the first conducting fluid;

wherein upon flow of the dielectric, first and second fluids, when an electrical potential difference is applied by the electrical potential generator to the first capillary tip and the second capillary tip, a steady state capillary jet is formed, producing a stream of charged droplets which move towards the steady state interface under the combined action of the electric and hydrodynamic forces; and wherein once the droplets reach the steady state interface they discharge and form an emulsion that leaves through the annular gap.

2. The system according to claim 1, wherein upon flow of the dielectric, first and second fluids, the steady state interface is located in between the first and second capillary tips.

3. The system according to claim 1, wherein the system comprises:

a number N of feeding tips with (N≥2), wherein one of the feeding tips is the first capillary tip; and N pumps, one each for each feeding tip, for pumping conducting fluid in the first flow direction within each of the N feeding tips, wherein one of the pumps is the pump for pumping the first conducting fluid, being an inner conducting fluid, in the first flow direction within the first capillary tip;

wherein upon flow of the dielectric, first and second fluids, in the first capillary tip flows the inner conducting fluid at a flow rate $Q_1$ whilst a generic conducting fluid Li-th flows at a generic flow rate $Q_i$ through the Ti-th tip (2≤i≤N); and wherein upon flow of the dielectric, first and second fluids, the N feeding tips are arranged such that the L(i−1)-th conducting fluid surrounds the Ti-th tip and the tips, that are immersed in the dielectric fluid, which is flowing at a rate $Q_D$.

4. The system according to claim 1, wherein the diameters of the capillary tips are between 0.001 mm and 5 mm.

5. The system according to claim 1, wherein upon flow of the dielectric, first and second fluids, the first conducting fluid flows at a flow rate of $Q_1$ in the first capillary tip, and the second conducting fluid flows at a flow rate of $Q_2$ in the second capillary tip;

wherein upon flow of the dielectric, first and second fluids, the flow rate $Q_1$-$Q_2$ is between $10^{-15}$ $m^3/s$ and $10^{-7}$ $m^3/s$; and wherein upon flow of the dielectric, first and second fluids, the flow rate $Q_D$ of the dielectric fluid and the flow rate $Q_1$ of the first conducting fluid are both between 0 and $10^{-1}$ $m^3/s$.

6. The system according to claim 1, wherein upon flow of the dielectric, first and second fluids, the dielectric conductivity of the first and second conducting fluids is between $10^{-12}$ and $10^6$ S/m.

7. The system according to claim 1, wherein upon flow of the dielectric, first and second fluids, the absolute value of the electric potential difference is between 1 V and 100 kV for obtaining a separation between the first capillary tip and the steady state interface of between 0.001 mm and 10 cm.

8. The system according to claim 1, wherein upon flow of the dielectric, first and second fluids, the first capillary tip is immersed in the dielectric fluid located close to the steady state interface, the dielectric fluid having a flow rate $Q_D$;

wherein the second capillary tip is located inside the first capillary tip and immersed in the dielectric fluid, such that upon flow of the dielectric, first and second fluids, the second conducting fluid flows through the second capillary against the dielectric fluid at a rate $Q_C$, such that the steady state interface separating the dielectric fluid and the second conducting fluid is formed somewhere inside the first capillary tip;

wherein upon flow of the dielectric, first and second fluids, the first conducting fluid forms a steady capillary jet when conducting fluids are connected to a reference electrode;

wherein upon flow of the dielectric, first and second fluids, the spontaneous breakup of the capillary jet produces droplets of the first conducting fluid which move towards the fluid interface under the combined action of electric forces and drag exerted by the moving dielectric fluid; and wherein upon flow of the dielectric, first and second fluids, the droplets release most of their electrical charge upon reaching the steady state interface, then exit the device through the annular gap.

9. An electro-fluidic method to produce emulsions and particle suspensions comprising:

immersion of a capillary in a dielectric fluid that flows along a micro-channel; said dielectric fluid being immiscible or poorly miscible with a first conducting fluid and a second conducting fluid; and wherein said second conducting fluid flows through a second capillary immersed in the dielectric fluid, an annular gap extending the length of the second capillary defined by the difference between the diameters of the micro-channel and the second capillary tip;

pumping counter-flow said second conducting fluid with respect to the dielectric fluid and forming a steady state interface; and applying an appropriate electrical potential difference to said conducting fluids, producing a stream of charged droplets which move towards the steady state interface under the combined action of the electric and hydrodynamic forces;

wherein once the charged droplets reach the steady state interface they give up their charge and form a neutral emulsion that leaves through the annular gap.

10. The method according to claim 9 further comprising:

immersion of a number N of feeding tips ($N \geq 1$) in the first conducting fluid, such that a generic conducting fluid Li-th co-flows with the first conducting fluid at a flow rate $Q_i$ through the Ti-th tip ($1 \leq i \leq N$); and arranging the feeding tips such that L(i−1)-th conducting fluid surrounds the Ti-th tip.

11. The method according to claim 10, wherein the diameters of the first and second capillary tips and the N feeding capillary tips are between 0.001 mm and 5 mm.

12. The method according to claim 10, wherein the flow rate $Q_{i\text{-}th}$ of the fluid Li-th conducting fluid flowing through the feeding tip Ti-th is in the range between $10^{-15}$ $m^3/s$ and $10^{-7}$ $m^3/s$; and wherein the flow rate $Q_D$ of the dielectric fluid and the flow rate $Q_C$ of the second conducting fluid are both between 0 and $10^{-1}$ $m^3/s$.

13. The method according to claim 9, wherein the dielectric conductivity of the first and second conducting fluids is between $10^{-12}$ and $10^6$ S/m.

14. The method according to claim 9 further comprising obtaining a separation between the first capillary tip and the steady state interface of between 0.001 mm and 10 cm;

wherein the absolute value of the electric potential difference is between 1 V and 100 kV.

15. An electro-fluidic method to produce emulsions and particle suspensions comprising:

immersion of a first capillary tip in a dielectric fluid that flows along a micro-channel in a first flow direction, wherein the dielectric fluid is immiscible or poorly miscible with a first conducting fluid and a second conducting fluid;

injecting in a second flow direction the second conducting fluid through a second capillary tip and forming a steady state interface, the second capillary tip immersed in the dielectric fluid and located downstream in the first flow direction from the first capillary tip, wherein the second flow direction of the second conducting fluid flows counter with respect to the first flow direction of the dielectric fluid, an annular gap extending the length of the second capillary defined by the difference between the diameters of the micro-channel and the second capillary tip; and applying an electrical potential difference to the first and second conducting fluids, producing charged droplets that move towards the steady state interface under the combined action of the electric and hydrodynamic forces;

wherein once the charged droplets reach the steady state interface, they give up their charge and form a neutral emulsion that travel through the annular gap.

* * * * *